US008573011B2

(12) United States Patent
Thoonsen

(10) Patent No.: US 8,573,011 B2
(45) Date of Patent: Nov. 5, 2013

(54) ANTITHEFT DEVICE FOR COMMODITY ITEMS

(75) Inventor: Jacky Thoonsen, Chateauroux (FR)

(73) Assignee: Thoonsen Trading, Chateuroux (FR)

( * ) Notice: Subject to any disclaimer, the term of this patent is extended or adjusted under 35 U.S.C. 154(b) by 0 days.

(21) Appl. No.: 13/273,904

(22) Filed: Oct. 14, 2011

(65) Prior Publication Data

US 2012/0073336 A1 Mar. 29, 2012

Related U.S. Application Data

(63) Continuation-in-part of application No. PCT/FR2010/050710, filed on Apr. 13, 2010.

(51) Int. Cl.
*E05B 65/00* (2006.01)

(52) U.S. Cl.
USPC ..... 70/57.1; 24/507; 206/1.5; 206/308.1; 206/387.11; 340/572.1; 340/572.9

(58) Field of Classification Search
USPC ..... 70/57.1; 24/507; 206/1.5, 387.11, 206/308.1, 308.2; 340/572.1, 572.7–572.9
See application file for complete search history.

(56) References Cited

U.S. PATENT DOCUMENTS

| | | | | | |
|---|---|---|---|---|---|
| 2,647,006 | A | * | 7/1953 | Coyle | 294/8.5 |
| 2,658,363 | A | * | 11/1953 | Simmons | 24/486 |
| 3,942,829 | A | * | 3/1976 | Humble et al. | 70/57.1 |
| 3,947,930 | A | | 4/1976 | Martens et al. | |
| 3,974,581 | A | * | 8/1976 | Martens et al. | 340/572.7 |
| 3,995,900 | A | * | 12/1976 | Humble et al. | 70/57.1 |
| 4,175,306 | A | * | 11/1979 | Bigelow et al. | 24/507 |
| 4,221,025 | A | * | 9/1980 | Martens et al. | 70/57.1 |
| 4,299,870 | A | * | 11/1981 | Humble | 24/704.2 |
| 4,380,097 | A | * | 4/1983 | Keifer | 70/57.1 |
| 4,483,049 | A | * | 11/1984 | Gustavsson et al. | 70/57.1 |
| 4,649,397 | A | * | 3/1987 | Heaton et al. | 343/895 |
| 4,670,950 | A | * | 6/1987 | Wisecup et al. | 70/57.1 |
| 5,019,801 | A | | 5/1991 | Anderson, III | |
| 5,334,354 | A | * | 8/1994 | Johnston et al. | 422/560 |
| 5,388,433 | A | * | 2/1995 | Andersson et al. | 70/57.1 |

(Continued)

FOREIGN PATENT DOCUMENTS

| | | |
|---|---|---|
| FR | 2 395 553 A1 | 1/1979 |
| WO | WO 02/35038 A2 | 5/2002 |

OTHER PUBLICATIONS

International Search Report mailed Aug. 29, 2011 for International Application No. PCT/FR2010/050710.

(Continued)

*Primary Examiner* — Suzanne Barrett
(74) *Attorney, Agent, or Firm* — Buchanan Ingersoll & Rooney PC

(57) ABSTRACT

An antitheft device designed to be attached to an off-the-shelf commodity item, preferably a piece of clothing, in particular in close proximity to the edge of the item, including a first so-called fastening part, provided with a nail-type pinning element, a second so-called attachment part, including a recess capable of receiving the said pinning element, a locking system designed to retain the pinning element in the said recess, the two parts being connected to one another so as to be movable relative to one another when the pinning element is outside the recess, and a spring providing the elastic mobility of the fastening part in relation to the attachment part.

11 Claims, 3 Drawing Sheets

(56) References Cited

U.S. PATENT DOCUMENTS

| | | | | |
|---|---|---|---|---|
| 6,185,795 | B1 * | 2/2001 | Shui-Shang | 24/507 |
| 6,374,647 | B1 * | 4/2002 | Holmgren | 70/57.1 |
| D468,223 | S * | 1/2003 | Huehner | D10/106.91 |
| 6,754,939 | B2 * | 6/2004 | Belden et al. | 24/704.1 |
| 6,848,285 | B2 * | 2/2005 | Stroh | 70/57.1 |
| 7,134,302 | B2 * | 11/2006 | Gorst | 70/57.1 |
| 7,356,889 | B2 * | 4/2008 | Alitowski | 24/521 |
| 7,394,376 | B1 * | 7/2008 | Sayegh et al. | 340/572.1 |
| 7,808,386 | B1 * | 10/2010 | Sayegh et al. | 340/572.1 |
| 2003/0221464 | A1 | 12/2003 | Stroh | |
| 2006/0070410 | A1 * | 4/2006 | Fuss et al. | 70/57.1 |
| 2006/0174667 | A1 * | 8/2006 | Garner | 70/57.1 |
| 2009/0064734 | A1 * | 3/2009 | Zinner | 70/57.1 |
| 2010/0188227 | A1 * | 7/2010 | Yang | 340/572.1 |

OTHER PUBLICATIONS

International Preliminary Report on Patentability and Written Opinion mailed Oct. 27, 2011 for International Application No. PCT/FR2010/050710.

* cited by examiner

ANTITHEFT DEVICE FOR COMMODITY ITEMS

This invention relates to a system that offers protection from theft, particularly shoplifting, for off-the-shelf items in a commercial retail establishment.

More precisely, the invention relates to a rigid antitheft device, of the security tag type, which is designed to be associated with items, particularly clothing items made of fabric, shoes, leather goods etc., and more generally any items that can be pierced by a pointed attaching component without damaging or deteriorating the item in any way after it is removed.

This type of known device usually comprises a first part made up of a pinning element in the form of a nail, and a second part made of moulded plastic comprising a recess that is capable of accommodating the said pinning element and containing a locking system that is designed to hold the pinning element in the recess, and a resonant electrical circuit associated with the said locking system.

The device is put in place on the item by pinning it onto one of the faces of the item with the nail and applying the second part opposite it on the other side of the item, so that the pointed stem of the nail going through the item is inserted in the appropriate recess and held there by the locking system.

For instance, patent application FR 2 395 553 describes such a device. The item to protect is thus pierced by the nail and held against the opposite part of the device, which retains the said nail. The resonant electrical circuit contained in the device can respond to the presence of a magnetic, radiofrequency or electromagnetic interrogation field of an outside detection system. When the item with an antitheft device goes through a surveillance or interrogation area, the electrical circuit of the antitheft device cooperates with the detection system put in place to trigger an alarm signal at the resonance frequency of the electrical circuit of the device.

The antitheft device is removed by means of a magnetic support tool, on which the part of the device with the locking system is applied. The locking system of the device comprises a retaining part made of magnetic material that is adapted to be moved and associated with a spring. By positioning the antitheft device bearing the locking system on the magnet, the creation of a magnetic field around the magnetic retaining part that is sensitive to the field leads to the said retaining part being attracted; the movement of the part releases the stem of the nail, which is then pushed back elastically by the spring. The two parts, that with the locking system and the nail, can then be separated from each other, and the nail remaining on the item can be removed.

Such antitheft devices are placed on thousands of items that are sold off-the-shelf. The operation for placing the devices, which remains manual to date, must be completed rapidly when the items are put into the store shelves or earlier on. However, this manual operation, which consists in holding a nail, piercing the item with the nail and presenting the part of the device that retains the nail against the other side of the item in front of the nail, requires a number of gestures that further have certain drawbacks.

Thus, the risk of pricking one's finger while grasping and putting in place the nail is large. Further, nails often fall to the floor, also leading to a non-negligible risk of pricking the feet of the personnel, who do not always have suitable shoes.

Besides, in order to position the part receiving the nail correctly on the other side of the item pierced by the nail, and to properly aim the recess designed for the nail, particularly with garments, it is generally necessary to turn the item over, which ultimately slows down the performance of the tasks.

Further, the device is generally placed at any location of the item, thus creating the risk of making it difficult to find when the customer checks out of the store, or even forgetting it, leading to inconvenience and dissatisfaction for the customer, who notices that well after leaving the place of sale.

What is more, when the device is removed by checkout staff, the person responsible for that operation must hold the item on the magnetic unlocking tool while retrieving the parts separately and placing them in distinct storage boxes, leading most often to the risk of losing at least one part of the device, generally the nail, which escapes when the item and the parts of the device are handled too fast.

Lastly, it remains possible to remove an item without paying for it, more particularly a piece of fabric or a garment. The device can be removed by cutting the fabric around the head of the nail to clear the fabric of the head. Such a cut, which is limited to the area of the head of the nail, can be sown up easily and may be considered to be not very damaging in view of what is gained.

Devices such as those disclosed in U.S. Pat. Nos. 3,947,930 or 5,019,801 offer a way to join the pinning element (nail) to the fastening part in order to avoid losing the nail when the nail is pinned onto the item or removed from it.

These devices thus provide a particularly useful solution. Besides, even if the removal of the nail from its recess is accompanied by a significantly elastic movement thanks to the material that makes up the element bearing the nail, it is still desirable to improve the way in which the nail is moved out of its recess.

This invention corrects the aforementioned drawbacks by offering a simpler antitheft device, minimising the risk of pricking and of losing a part of the device, and improving its handling.

To that end, the device according to the invention, designed to be attached to an off-the-shelf commodity item, preferably a piece of clothing, in particular in close proximity to the edge of the item, comprises a first so-called fastening part, provided with a nail-type pinning element, and a second so-called attachment part, comprising a recess capable of receiving the said pinning element, and a locking system designed to retain the pinning element in the said recess, the two parts being connected to one another so as to be movable relative to one another when the pinning element is outside the recess, and characterised in that the device comprises a spring providing the elastic mobility of the fastening part in relation to the attachment part.

Thus, the pinning element always remains associated with the attachment part, with which it is designed to cooperate for putting in place the antitheft device on the item, avoiding the risk of losing the pinning element when it is attached to the item or removed from it.

Further, the spring makes it possible to open the fastening element very speedily out of its recess, giving it a guaranteed spring effect for ejection, thus making the handling of the device speedier. The time saved in that manner is valuable considering the totality of the operations, including that of manipulation, that are required from store staff.

Besides, the use of a spring makes the device more durable. That is because the flexibility of the devices of the prior art is provided by the material that makes up the device and/or the curved shape of the joining area between the fastening part and the attachment part. But such configurations lead to wear and tear of the device over time, fragility in the said joining area, and even the risk of breaking in that area.

According to one characteristic, the spring is carried by a pin extending along a plane that is substantially transversal to the direction in which the fastening element is inserted or removed.

According to one characteristic, the fastening part constitutes a means to guide the pinning element for inserting it in the recess and a means for ejecting the said pinning element outside the said recess. The user does not need to turn the item over after piercing it with the nail to aim for the recess designed for the nail, as the fastening part is sufficient in itself for guiding the nail without checking the movement, unlike in the prior art.

Advantageously, the fastening part comprises an oblong body preferably shaped like a tab, which extends longitudinally from its base integral with one edge of the attachment part up to its free opposite end bearing the pinning element, and has an appropriate length so that the pinning element is arranged directly opposite the recess.

That configuration of the fastening part makes for speedy attachment of the device on the item to protect by allowing, virtually simultaneously, the step of pinning onto the item and the step of inserting the pinning element in the recess in the attachment part for locking it there.

Further, the device according to the invention is thus advantageously used like pliers to pin the item to protect from theft.

That integral design prevents virtually all attempts to cut the item around the nail as is sometimes the case with current devices. That is because without the authorised tool, taking the device off the item would make it necessary to cut the item from the end of the part with the pinning element up to the edge of the part, making a cut that would be too large to allow imperceptible sewing up.

Further, the antitheft device can only be placed near the edge of an item to protect from theft, because the two parts of the device are integral with each other. The location of the device makes it easy to locate on the item when it is to be removed at the checkout.

According to one characteristic, the fastening part is appropriately thick and shaped, particularly with a curved profile that is concave towards the inside of the device, so that it is both rigid and elastic in order to apply a return force in the locked position of the pinning element in the recess.

Preferably, the body of the fastening part has an inner face in front of the attachment part and an opposite outer face, the outer face being convex on the surface and/or the inner face having a reinforcing rib, preferably elongated and median, which extends longitudinally to the body. These two alternative embodiments help make the tab rigid and strong.

Preferably, the fastening part is made of plastic, particularly PVC or PEHD.

According to another characteristic, the fastening part and the attachment part are made integral by moulding, gluing or non-removable fitting. In particular, the fastening part comprises two parts, one part with the pinning element and another part, at the edge of which the first part is connected and which constitutes a closing element for the fastening part accommodating the locking system.

According to another characteristic, the pin of the spring is made integral, firstly with a distal end of the fastening part opposite the part bearing the pinning element and secondly with a portion of the peripheral edge of the fastening part.

The spring pin is made integral with the joining area of the fastening and attachment parts by crimping.

According to another characteristic, the pinning element comprises a head and a stem extending from the head and ending at a pointed end, the head being made integral, preferably by moulding or crimping, with the free end of the fastening part.

Further, the device comprises, at the hole for inserting the pinning element into the recess, a flared entry that makes it easier to guide the end of the pinning element into the inside of the recess.

Lastly, the electronic theft detection system is preferably accommodated in the attachment part.

The invention will be better understood in the light of the description below, which shows non-limitative examples of embodiment of the device of the invention, by reference to the drawings enclosed, wherein.

Figure 1:
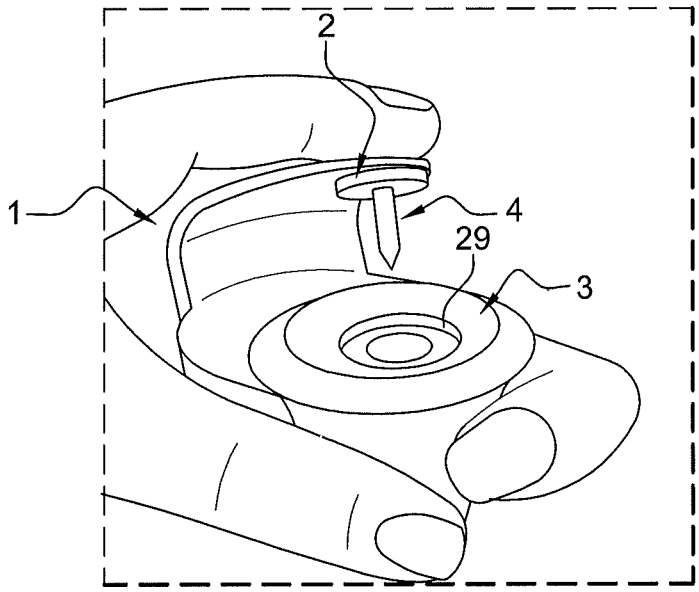
FIG. 1 represents a perspective view of a first preferred embodiment of the device of the invention, working in the hand of a user.
Figure 2:
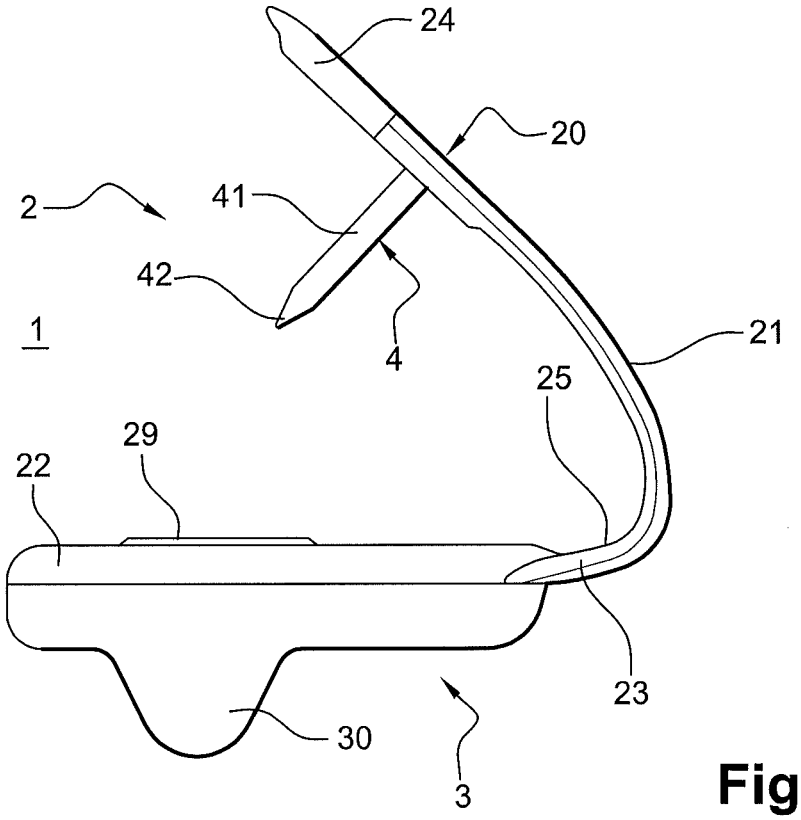
FIG. 2 represents a schematic profile view of the device according to the invention in the unlocked position.
Figure 3:
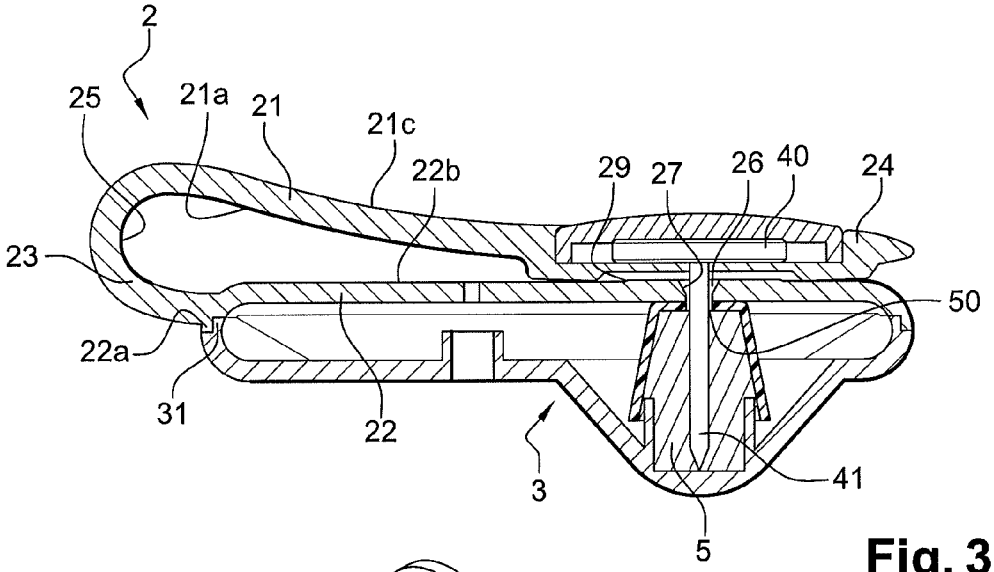
FIG. 3 represents a schematic cross section of the device according to the invention in the locked position.
Figure 4:
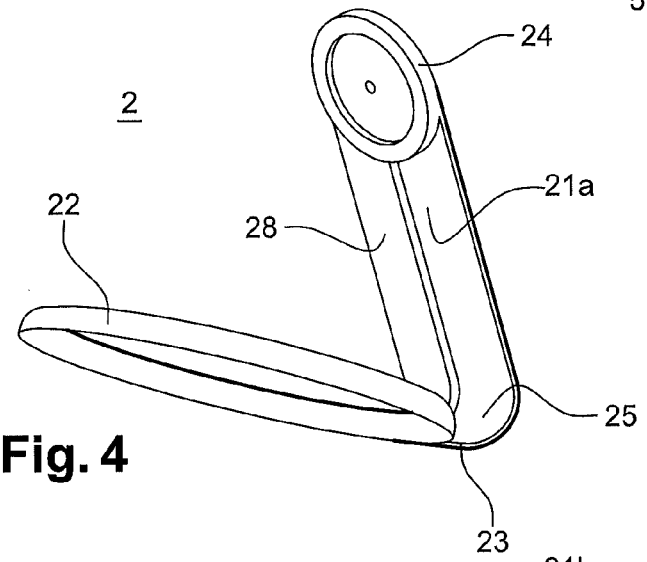
FIG. 4 represents a perspective view of part of the device according to a second preferred embodiment of the invention.
Figure 5:
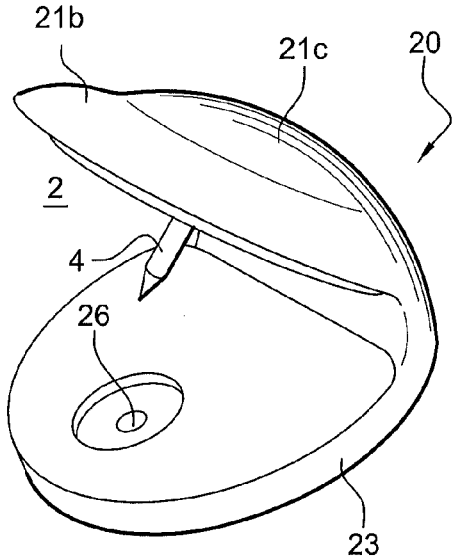
FIG. 5 represents a perspective view of a part of the device according to a third preferred embodiment of the invention.

The antitheft devices 1 represented in FIGS. 1 to 3 in one embodiment and in FIGS. 4 and 5 in alternative embodiments are non-limitative examples of embodiments. They are designed to be attached to off-the-shelf items in commercial retail establishments, for instance clothing, leather goods or sports goods, to protect them from shoplifting.

An antitheft device 1, as illustrated in FIG. 1, comprises according the invention two parts 2 and 3 connected to each other. The first part, called the fastening part 2, is designed to pierce the item to protect from theft (not represented), while the second part, called the attachment part 3, is designed to be affixed against the item and hold the fastening part.

The parts 2 and 3 are preferably made of plastic, particularly polyvinyl chloride (PVC), or high-density polyethylene (PEHD).

The antitheft device 1 makes up a single assembly, the fastening part 2 being mobile in relation to the fixed attachment part 3, or inversely like a clip.

The fastening part 2, as visible in FIG. 2, comprises a body 20 and a pinning element 4 designed to pierce the item to protect from theft.

The body 20 of the part 2 comprises at least one part 21 called tab in the document below, which has an oblong shape and is a few millimetres thick.

In the embodiment described below, the body 20 further comprises a second part 22 which is substantially flat, to which is joined the tab 21. That second part 22 makes the tab 21 integral with the attachment part 3. It is made integral with the attachment part 3 by gluing, moulding or non-removable fitting.

The tab 21 comprises a first end or base 23 connected to the edge of the flat part 22 and a free opposite end 24 provided with the pinning element 4.

The base 23 of the tab extends towards the central part of the flat part with a curved profile 25 that is concave towards the inside of the device.

The tab is sufficiently rigid to be maintained, when idle, in the raised position in relation to the attachment part 3 as visible in FIG. 2, and sufficiently flexible, particularly with a curvature radius adapted to the curved profile 25, to give it the mobility required in order to make it cooperate with the attachment part 3.

The length of the tab 21 from its base to its free end 24 is adapted so that the pinning element 4 is substantially in line with the recess in the attachment part 3 with which it is designed to cooperate as will be seen below.

Because of its shape and thickness and the elasticity of the material that makes it up, the tab 20 is thus sufficiently flexible to make it mobile in relation to the attachment part 3 with amplitude ranging from a so-called idle position and a so-called locking position. The idle position is that in the view in FIG. 2, where the pinning element 4 joined to the fastening part 2 does not cooperate with the attachment part, whilst the locking position is that of the view in FIG. 3 where the pinning element 4 cooperates with the inside of the attachment part 3 and is locked there.

Other than the thickness and nature of the material making up the tab, which make the said tab rigid to a certain extent, its rigidity can be reinforced, by reference to FIG. 4, by a median longitudinal rib 28 placed on the inner face 21*a* of the tab 21 in front of part 3, and extending from the base 23 to the vicinity of the end 24 that accommodates the nail 4. That reinforcing rib gives the tab higher breaking strength to resist the high tension to which it is subject in the locked position.

FIG. 5 illustrates an alternative of the fastening part 2 wherein the rigidity of the tab is reinforced by its outer face 21 b opposite the inner face 21*a*, which side has a convex part 21*c* in its median area.

The pinning element 4 is made integral with the end 24 of the tab 21 so that it can follow the movement of the tab 21 in relation to the attachment part 3.

Several types of pinning element 4 of a known type may be envisaged, to such as nails, needles or pins.

For example, the pinning element takes the form of a nail comprising a head 40 and a stem 41, the end 42 of which is pointed to completely pierce an item, and turned towards the attachment part 3.

The head 40 is firmly associated with the end 24 of the tab by crimping, moulding, clipping etc.

The attachment part 3 is designed to receive the pinning element or nail 4 after attaching it to the item to protect.

As illustrated on the sectional view in FIG. 3, the attachment part includes a body 30 in which is placed a locking system 5 adapted to retain the pinning element 4, and a resonant electronic system of a known type (not represented) designed to cooperate with an external detection and alarm emitter/transmitter.

The locking system 5, the technical details of which are not described here because they are of a type known in itself, includes a receiving recess 50 in a shape that is capable of receiving the stem 41 of the pinning element 4.

The body 30 of the attachment part 3 is closed by the flat part 22 of the fastening part 2 with peripheral cooperation 31 and 22*a* of the body 30 and the flat part 22 respectively. Such cooperation is carried out preferably by non-removable fitting.

Alternatively, the body 30 could be constituted by a closed shell made either from two half shells cooperating with each other or with a single closed element moulded around the locking system and the resonant electronic system. The fastening part 2 would not need to include the flat part 22 and could be limited to the tab 21 which could be made integral with the body 30 at its base 23.

The thickness of the flat part 22 of the fastening part comprises, in front of the entry of the recess 50 of the attachment part 3, a hole 26 designed to be crossed by the nail 4 for inserting it in the said recess 50.

Advantageously, the hole 26 has a shape that is substantially like a funnel, so as to have a flared entry 27 near the face 22*b* of the flat part 22 opposite the tab. The sloping wall of the hole in the direction of part 3 makes it possible to make a stop for the nail during insertion, substantially vertically from the said hole, and make it easier to guide.

Figure 6:
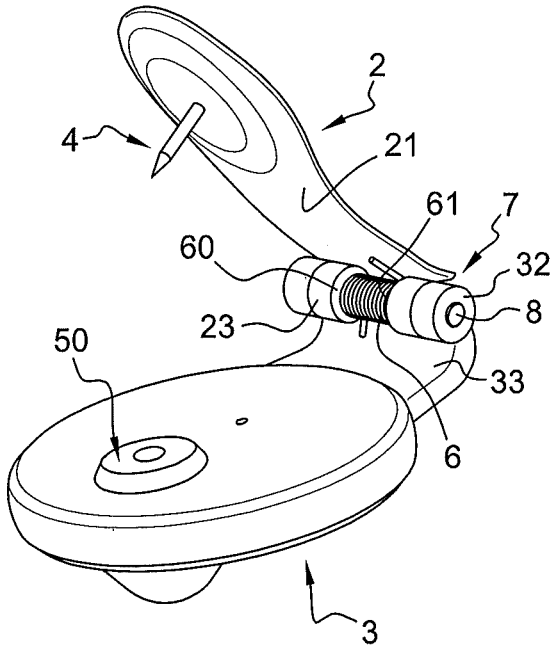
FIGS. 6 and 7 are a perspective view and a sectional view respectively of the device according to a preferred embodiment of the invention.
Figure 7:
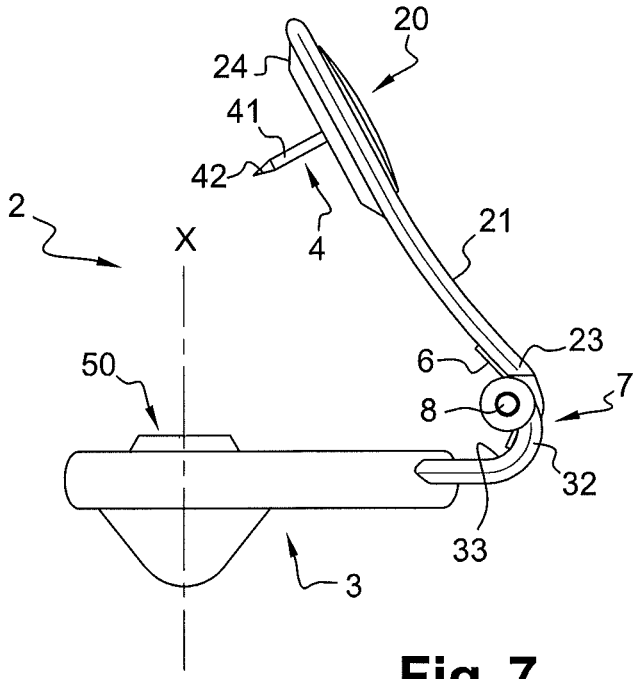

Lastly, in a known manner, a circular shoulder 29 is provided projecting from the face 22*b* of the flat part 22 around the hole 26. Its diameter is substantially equal to the diameter of the head 42 of the nail. In the locked position, the shoulder creates an obstacle for fitting lifting means if an attempt is made to insert it under the elastic tab and under the head of the nail, so as to pull the nail out of the locking system and therefore remove the antitheft device. In another embodiment illustrated in FIGS. 6 and 7, the device according to the invention comprises a spring 6 associated with the joining area 7 of the attachment part 3 to the fastening part 2.

These figures include the same references as the corresponding references in the other embodiments described above.

The elastic movement of the fastening part for ejecting the fastening element 4 out of the recess 50 is achieved thanks to the spring 6.

The spring 6 is borne by a pin 8 made integral both with the base 23 of the tab 21 and a portion 32 of the peripheral edge of the attachment part 3. The pin 8 is arranged in a plane that is substantially transversal to the direction X of fitting and removal of the fastening element. Alternatively, a spring may be used, which is arranged along a line parallel to the direction X and placed between two stops.

The spring is arranged between two stops 60 and 61 supplied by the base 23, but which may be constituted by other means. The spring is appropriately stiff for the return force required for ejection.

To also take part in the spring effect, the joining area 7, for example in the immediate vicinity of the portion 32, particularly has, on part 33 of the attachment part, a curved profile that is concave towards the inside of the device.

This embodiment with a spring provides extremely fast opening, and is a guarantee of durability of the system, both in terms of "automated" opening and in terms of mechanical strength.

The working of the antitheft device of the invention will now be described.

To attach the antitheft device on an item, the item is placed along its thickness between the two parts 2 and 3, preferably till its edge comes up to the curved part 25; the device takes the form of an open clip and the tab 21 naturally adopts its idle position because it is subject to no outside constraint.

As illustrated in FIG. 1, only one hand is used to operate the antitheft device 1.

Indeed, the clip shape of the device 1 makes it possible to place the attachment part 3 between the index and middle finger, and position the thumb on the head 40 of the nail joined to the tab. By applying pressure with the thumb, the nail 4, which is integral with the tab, is moved towards the part 3. The nail 4 pierces the item and is automatically inserted in the hole 26 of the flat part 22 then in the recess 50 of the part 3 without having to aim and check as in the prior art. The nail 4 is pressed till it is locked in recess 50.

According to the invention, the fastening part 2, particularly the tab 21, constitutes a means to guide the nail while inserting it in the recess 50 of the attachment part, because of its shape or the presence of the spring 6.

To remove the device from the item, the body 30 of the attachment part 3 is placed on a tool (not represented and known in itself), adapted for unlocking the locking system of the part. Unlocking releases the nail in recess 50.

According to the invention, the fastening part 2, particularly the tab 21, constitutes a means to eject the nail outside the recess 50 of the attachment part, because of its shape or the presence of spring 6. That is because in the locked position, the elastic tab 21 applies return force that allows the nail to be pulled out of its recess by the spring effect when it is no longer held in its recess.

The nail 4 can then be removed from the item.

As a result, the fastening part 2, which comprises the pinning element 4 and is integral with the attachment part 3 according to the invention, thus makes it possible to constitute a single assembly for the device, with no risk of losing the pinning element.

Besides, the risk of pricking is reduced because of the arrangement of the pinning element, the pointed end of which remains turned towards the inside of the device.

Further, the device in the invention is extremely easy to handle and control with just one hand, allowing cooperation between the nail and the automatic locking system without any need to aim at it or control the movement.

The invention claimed is:

1. An antitheft device designed to be attached to an off-the-shelf commodity item, preferably a piece of clothing, in particular in close proximity to the edge of the item, comprising a first fastening part, provided with a nail-type pinning element;

a second attachment part, comprising a hole capable of receiving the said pinning element;

a locking system designed to retain the pinning element in the said hole, the two parts being connected to one another so as to be movable relative to one another when the pinning element is outside the hole; and a spring providing the elastic mobility of the fastening part in relation to the attachment part, wherein said device comprises an electronic theft detection system, said electronic theft detection system being accommodated in the attachment part and wherein the hole has a flared opening and a generally funnel shape, the flared opening being operable to guide the pinning element into the hole during attachment.

2. A device according to claim 1, wherein the spring is carried by a pin extending along a plane that is substantially transversal to the direction in which the pinning element is inserted or removed.

3. A device according to claim 2, wherein the pin of the spring is made integral, firstly with a distal end of the fastening part, and secondly with a portion of a peripheral edge of the fastening part.

4. A device according to claim 3, wherein the spring pin is made integral with a joining area of the attachment part of the attachment part and fastening part, by moulding and/or crimping.

5. A device according to claim 1, wherein the fastening part constitutes a means to guide the pinning element for inserting the pinning element in the hole and a means for ejecting the said pinning element outside the said hole.

6. A device according to claim 1, wherein the fastening part comprises an oblong body which extends longitudinally from the fastening device, is integral with one edge of the attachment part, includes a free opposite end of the fastening part which bears the pinning element, and has a length so that the pinning element is arranged directly opposite the hole.

7. A device according to claim 1, wherein the fastening part is shaped, particularly with a curved profile that is concave towards the inside of the device, so that the fastening part is both rigid and elastic in order to apply a return force in the locked position of the pinning element.

8. A device according to claim 6, wherein the body of the fastening part has an inner face in front of the attachment part and an opposite outer face, the outer face being convex on the surface and/or the inner face having a reinforcing rib, preferably elongated and median, which extends longitudinally to the body.

9. A device according to claim 1, wherein the fastening part is made of plastic, particularly PVC or PEHD.

10. A device according to claim 1, wherein the fastening part and the attachment part are made integral by moulding, gluing or non-removable fitting, in particular, the fastening part comprises two parts, one part with the pinning element and a second part having an edge at which the first part is connected and which constitutes a closing element for the fastening part.

11. A device according to claim 1, wherein the pinning element comprises a head and a stem extending from the head and ending at a pointed end, the head being made integral, preferably by moulding or crimping, with the free end of the fastening part.

* * * * *